US012000326B2

(12) United States Patent
Martin

(10) Patent No.: US 12,000,326 B2
(45) Date of Patent: Jun. 4, 2024

(54) ENGINE SYSTEM

(71) Applicant: Perkins Engines Company Limited, Peterborough (GB)

(72) Inventor: Jamie Andrew Martin, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 18/211,921

(22) Filed: Jun. 20, 2023

(65) Prior Publication Data

US 2024/0011427 A1 Jan. 11, 2024

(30) Foreign Application Priority Data

Jul. 6, 2022 (GB) ..... 2209922

(51) Int. Cl.
*F01P 11/02* (2006.01)
*F01P 5/10* (2006.01)

(52) U.S. Cl.
CPC ..... *F01P 11/0285* (2013.01); *F01P 5/10* (2013.01)

(58) Field of Classification Search
CPC ..... F01P 11/028; F01P 11/0285; F01P 3/00; F01P 3/20; F01P 7/14; F01P 5/10; B01D 19/0042; B01D 19/0057
See application file for complete search history.

(56) References Cited

U.S. PATENT DOCUMENTS 2,200,620 A 5/1940 Findley
4,062,231 A 12/1977 Mercik, Jr. et al.
4,200,065 A * 4/1980 Buddenhagen ..... F01P 11/029 123/41.51
4,776,390 A 10/1988 Crofts
5,255,636 A 10/1993 Evans
5,410,991 A 5/1995 Beaudry et al.
8,851,026 B2 10/2014 Brinkmann et al.
9,926,994 B2 3/2018 Dieter et al.
2014/0374066 A1 * 12/2014 Iwatsuki ..... B01D 19/0057 165/104.19

(Continued)

FOREIGN PATENT DOCUMENTS

CN 103046994 A 4/2013
DE 10143091 A1 3/2003

(Continued)

OTHER PUBLICATIONS

European Extended Search Report for Europe Patent Appln. No. 23179426.4, dated Oct. 25, 2023 (7 pgs).

(Continued)

*Primary Examiner* — Grant Moubry
*Assistant Examiner* — James G Moubry

(57) ABSTRACT

The present disclosure relates to an engine system having an engine and a cooling system. An engine vent line is fluidly connected to the engine for venting air from the engine system and bypassing the coolant flow circuit. The engine vent line has a hydraulic diameter and length selected to provide a predetermined engine head loss for the engine and a rate of flow of coolant in the at least one engine vent line at or below a maximum engine vent flow rate target during operation of the engine. The engine vent line comprises a helical section in which a portion is formed into a helix.

7 Claims, 3 Drawing Sheets

(56) References Cited

U.S. PATENT DOCUMENTS

2019/0162107 A1* 5/2019 Schmitz ..... F01P 11/0285

FOREIGN PATENT DOCUMENTS

| | | | | |
|---|---|---|---|---|
| FR | 2905737 | A1 | 3/2008 | |
| KR | 20180076671 | A | 7/2018 | |
| SE | 521618 | C2 * | 11/2003 | ..... F01P 11/028 |
| WO | 7900350 | A1 | 6/1979 | |

OTHER PUBLICATIONS

Great Britain Search Report related to Application No. 2209922.0: reported on Jan. 6, 2023.

* cited by examiner

ENGINE SYSTEM

CROSS-REFERENCE TO RELATED APPLICATION

This application claims priority under 35 USC § 119 and the Paris Convention to Great Britain Patent Application No. 2209922.0 filed on Jul. 6, 2022.

TECHNICAL FIELD

The present disclosure relates to an engine system having an engine and a cooling system and at least one vent line for venting air from the engine system during filling with coolant and whilst the engine is running. The engine which may include an emission reduction technology, such as exhaust gas recirculation (EGR), diesel particulate filters (DPF), selective catalytic reduction (SCR) and the like.

BACKGROUND

It is known to provide engine cooling systems, in which a flow of coolant is pumped through various engine components, such as the engine block, to capture heat from the components. The coolant is warmed by heat from the engine, and the heat is released from the coolant by means a cooling device, such as a radiator, through which the coolant passes. The cooling system may include a temperature control device, usually a control valve, thermostatic, electronic or the like, for regulating coolant flow between the engine and cooling device based on one or more engine parameters, such as engine speed, engine temperature, coolant temperature etc., to improve engine efficiency.

In many systems, the temperature control device is actuated by a change in the coolant temperature. When the coolant temperature is below a pre-set minimum temperature threshold, the temperature control device directs the coolant flow so that it is circulated through the engine without passing through the cooling device. When the coolant temperature reaches or is higher than the threshold, the temperature control device directs the coolant flow to the cooling device. Thus, during a cold start of an engine, i.e. before a minimum operating temperature of the engine has been reached and the temperature of the coolant is below the threshold temperature, the coolant flow is directed via a bypass circuit which bypasses the cooling device. This allows the engine and coolant to heat up rapidly, thereby shortening the warm-up phase. Once the threshold temperature of the coolant is reached, which indicates that the engine has reached its minimum operating temperature, the temperature control device directs the coolant to circulate through the cooling device. In low-load and/or low temperature situations, if the coolant temperature drops below the threshold, temperature control device redirects the coolant via the bypass circuit, until the threshold temperature is reached.

EGR is used as an emission reduction technology in internal combustion engines, wherein a portion of an engine's exhaust gas is recirculated back to the engine cylinders. EGR may be used to reduce emissions of oxides of nitrogen including NO and $NO_2$. A typical EGR system may include a conduit, or other structure, fluidly connecting a portion of the exhaust path of an engine with a portion of the air intake system of the engine, thereby forming an EGR path. Different amounts of exhaust gas recirculation may be desirable under different engine operating conditions and, in order to regulate the amount of exhaust gas recirculation, such systems typically employ an EGR valve that is disposed at some point in the EGR path. The EGR valve may be located either upstream or downstream of an EGR cooler, which is located in the EGR path to cool the exhaust gas before it is mixed with the charge air. The EGR cooler may be connected to the main coolant circuit so that the same coolant flows through the other engine components and the EGR cooler. An EGR system may be inactive at low engine/coolant temperatures to protect itself from condensation (that leads to corrosion damage and/or fouling and long term loss of effectiveness). Other emission reduction systems, such as DPF, SCR, may rely on engine/coolant temperature for their operation. As such the cleaning/regeneration cycle may be disabled below certain coolant temperature because the coolant temperature is an indicator of exhaust gas temperature that needs to be sufficiently high for successful operation. Thus when the temperature of the engine is low, the after-treatment system may be inefficient or disabled and the exhaust gas emissions may not meet the emission standards until the temperature of the after-treatment device reaches the minimum temperature.

The engine system typically includes a coolant vent line which extends from the highest point of the engine or an associated module (such as an EGR cooler), which bypasses the main coolant flow circuit, to allow degassing of the engine during operation and to prevent airlocks whilst the coolant is filled. However, as coolant is also able to pass through the coolant vent line, as the vent flow bypasses the temperature control device, this may increase the cooling effect, which may delay or prevent the engine from reaching the minimum operating temperature. As indicated above, running at low coolant temperatures may prevent the engine from operating efficiently and may affect after-treatment systems.

SUMMARY

The disclosure therefore provides an engine system comprising an engine and a cooling system. The cooling system comprises a cooling device, a coolant flow circuit fluidly connecting the engine and the cooling device and a pump for circulating coolant through the coolant flow circuit. The engine system further comprises at least one engine vent line fluidly connected to the engine for venting air from the engine system and bypassing the coolant flow circuit, said at least one engine vent line having a hydraulic diameter and length selected to provide a predetermined engine head loss for the engine and a rate of flow of coolant in the at least one engine vent line at or below a maximum engine vent flow rate target during operation of the engine, said at least one engine vent line comprising a helical section in which a portion of the at least one engine vent line is formed into a helix.

The disclosure further provides a method of determining the hydraulic diameter and length of the at least one engine vent line as described above, comprising the steps of selecting a plurality of combinations of nominal hydraulic diameter and nominal length for the at least one engine vent line; using the Darcy-Weisbach equation to calculate the head loss for a range of flow rates for each combination of nominal hydraulic diameter and nominal length; generating flow rate curves for each combination of nominal hydraulic diameter and nominal length; and determining a combination of hydraulic diameter and length the at least one engine vent line which provide the predetermined engine head loss for the engine at or below the maximum engine vent flow rate target by interpolation from the flow rate curves for each combination of nominal hydraulic diameter and nominal length.

DETAILED DESCRIPTION

Figure 1:
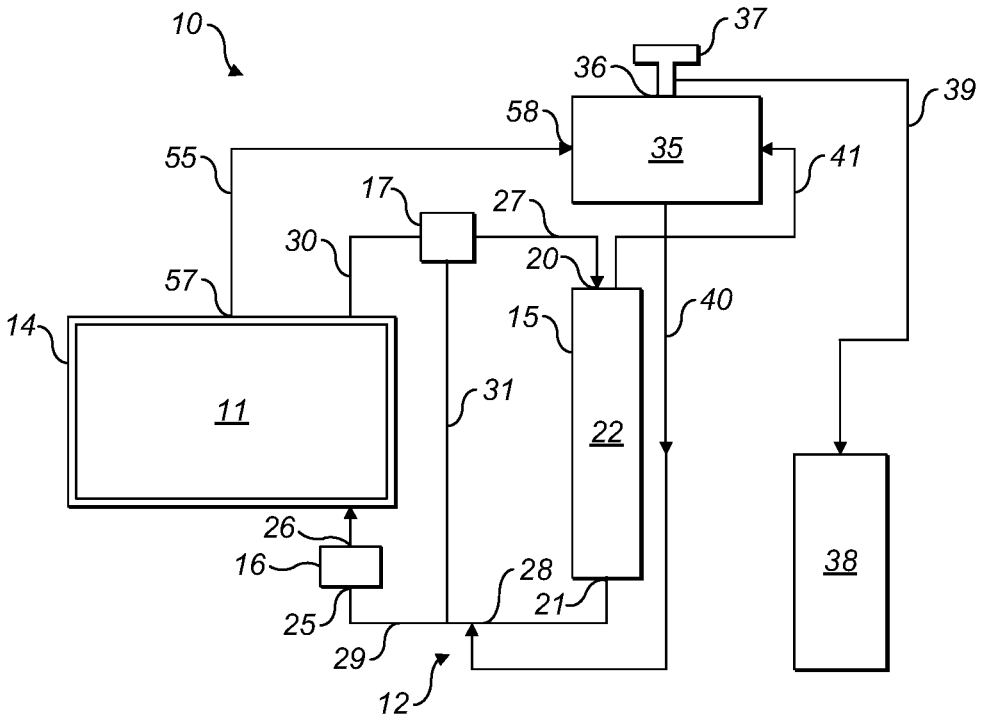
FIG. 1 is a diagrammatic representation of an engine system including an engine and a cooling system.

FIG. 1 shows an exemplary engine system 10. The engine system 10 may be used in various types of machines and vehicles associated with industries including, but not limited to, transportation, construction, mining, agriculture, forestry, waste management, and material handling and electric power generation. The engine system 10 may be used to power a machine, such as a backhoe loader, an excavator, and the like.

The engine system 10 may include an engine 11 and a cooling system 12 associated with the engine 11. The engine 11 may be an internal combustion engine. The engine 11 may be a spark ignition engine or a compression ignition engine, such as, a diesel engine, a homogeneous charge compression ignition engine, or a reactivity controlled compression ignition engine, or other compression ignition engines known in the art. The engine 11 may be configured to operate on fuels such as gasoline, diesel fuel, biodiesel, alcohol, natural gas, dimethyl ether (DME), liquefied petroleum gas (LPG), vegetable oils, landfill gases or a combination thereof. The engine 11 may be of multi-cylinder type, or a single-cylinder engine. Moreover, the engine 11 may be of a V-type configuration, an in-line configuration, or a radial configuration. The engine 11 may include a number of cylinders defining combustion chambers therein. The combustion chamber may receive a fuel or an air-fuel mixture that is ignited to execute a power stroke to generate desired power output for the machine. Combustion of the fuel or the air fuel mixture will result in heat generation inside the engine 12.

The cooling system 12 may be configured to cool the engine 11 by circulating liquid coolant through the engine 11 in a manner such that the coolant absorbs heat from one or more components of the engine 11. The engine 11 may include plurality of cooling channels internally defined by the engine block and the cylinder head forming an engine cooling jacket 14 to facilitate coolant flow to cool the engine 11 during operation. The coolant may be a mixture of water and an antifreeze solution, and the antifreeze solution may include ethylene glycol, propylene glycol, glycerol or another suitable fluid for the purpose of freezing point suppression and/or boiling point elevation.

The cooling system 12 may include at least one cooling device 15, a coolant pump 16, a temperature control device 17 and a plurality of conduits 27, 28, 29, 30, 31.

The cooling device 15 may include a cooling device inlet 20, a cooling device outlet 21 and a heat exchange portion 22 disposed between the cooling device inlet 20 and the cooling device outlet 21. The heat exchange portion 22 may be adapted to cool the coolant received from cooling device inlet 20 and supply the coolant to the cooling device outlet 21. The cooling device 15 may be any suitable device, such as a radiator including one or more radiator tubes arranged therein to allow heat transfer between the coolant flowing through the radiator tube(s) and the surrounding air. Movement of the surrounding air to increase the heat transfer may rely on movement of the machine or vehicle or may be forced by a fan or blower. The fan may be mechanically connected to the engine 11 or driven by other means such as hydraulics, or an electric motor. The cooling device inlet 20 may be connected to a cooling device inlet conduit 27 and the cooling device outlet 21 may be connected to a cooling device outlet conduit 28.

The coolant pump 16 may have a coolant pump inlet 25 connected to a coolant pump inlet conduit 29, which is connected to the cooling device outlet conduit 28, so that the coolant pump 16 is fluidly connected to the cooling device 15. The coolant pump 16 may be configured to supply the coolant from the cooling device 15 to the engine 11 directly, or via another component of the engine 11. Such another component may be an oil cooler (not shown), which is configured to cool lubricating oil associated with the engine 11 by exchanging heat with coolant received from the coolant pump 16. The coolant pump 16 may have a coolant pump outlet 26 fluidly coupled to the engine cooling jacket 14 and configured to facilitate flow of the coolant through the engine cooling jacket 14. The coolant pump 16 may be any type of known positive displacement pump or rotodynamic pump such as centrifugal pumps, mixed flow pumps, axial pumps and the like. The coolant may exit the engine cooling jacket 14 via an engine outlet conduit 30 positioned downstream of the engine 11, which may be connected to the cooling device inlet conduit 27. The cooling device outlet conduit 28, coolant pump inlet conduit 29, engine outlet conduit 30 and cooling device inlet conduit 27 may therefore define a cooling flow path.

A bypass conduit 31 may be provided, which fluidly extends from the junction at which the engine outlet conduit 30 and the cooling device inlet conduit 28 are connected to the junction at which the cooling device outlet conduit 28 and the coolant pump inlet conduit 29 are connected. The engine outlet conduit 30, the bypass conduit 31 and the coolant pump inlet conduit 29 may therefore define a bypass flow path. It should be noted that the cooling device inlet conduit 27 and the engine outlet conduit 30 may be formed from a single pipe or tube and there may be no physical junction therebetween. Similarly, the cooling device outlet conduit 28 and the coolant pump inlet conduit 29 may be formed from a single pipe or tube and there may be no physical junction therebetween.

The temperature control device 17, which may be a thermostat, may be positioned at the junction of the bypass conduit 31, the engine outlet conduit 30 and the cooling device inlet conduit 27, as shown in FIG. 1. Alternatively, it may be positioned at the junction of the bypass conduit 31, the cooling device outlet conduit 28 and the coolant pump inlet conduit 29. The temperature control device 17 may be configured to regulate flow of the coolant between the engine 11 and the cooling device 15 based on one or more engine parameters via the cooling flow path or the bypass flow path. The engine parameters may include, for example, engine temperature and coolant temperature. A temperature sensor, which may be positioned in the engine outlet conduit 30 or at a suitable location within the engine cooling jacket 14, may be configured to monitor temperature of the coolant flowing out from the engine 11 and the measured temperature may be used by the temperature control device 17 to determine the flow path to be used. Alternatively, the temperature control device 17 may be any conventionally known thermostat that includes a valve element having a thermally sensitive element, such as wax. The thermally sensitive element may cause the valve element of the thermostat to open and close based on the coolant temperature alone.

When the temperature of the coolant is below a pre-set threshold temperature $T_1$, the coolant leaving the engine 11 via the engine outlet conduit 30 may be directed by the temperature control device 17 to flow via the bypass flow path back to the coolant pump inlet conduit 29 and back to the engine 11, thereby avoiding the cooling device 15. When the temperature of the coolant reaches the pre-set threshold temperature $T_1$, the temperature control device 17 may close the bypass flow path and the coolant leaving the engine 11 via the engine outlet conduit 30 may be directed to flow along the cooling flow path to the cooling device 15 for cooling, before being recirculated to the engine 11. The temperature control device 17 may therefore have a closed position, to facilitate coolant flow through the bypass conduit 31 and to block the coolant flow to the cooling device inlet conduit 27. The temperature control device 17 may operate in the closed position when the coolant temperature in the engine outlet conduit 30 is below the threshold temperature $T_1$. The temperature control device 17 may have a second position, such as a fully open, to direct the coolant flow from the engine outlet conduit 30 to the cooling device inlet conduit 27, thereby blocking the coolant flow through the bypass conduit 31. The temperature control device 17 may operate in the open position when the temperature of the coolant is greater than threshold temperature $T_1$ In addition to the closed position, in which all of the coolant is directed along the bypass flow path and the fully open position, in which all of the coolant is directed along the cooling flow path the temperature control device 17 may also have a number of intermediate positions, which allow flow through both paths. Additionally, the temperature control device 17 may open various circuits in various stages, e.g. closed first for faster engine warmup, then open cab heater circuit to keep occupant comfortable, then open radiator circuit. Alternatively, it may open a cylinder head circuit first and cylinder block circuit later. Other combinations are also known.

The engine 11 may include an emission reduction system, such as exhaust gas recirculation (EGR) (not shown), which may include a cooling device, such as an EGR cooler or other engine/machine systems which may rely on coolant supply or coolant temperature for their correct operation.

The temperature of the coolant may vary during operation of the engine 11, which means that the volume of the coolant may not be constant due to thermal expansion of the fluid. There may be some air or other gases of the cooling system 12, or some air mixed with coolant especially after filling the cooling system 12. Gas may come from the degassing of dissolved gasses in the coolant, coolant evaporation or normal or faulty operation of certain components, such as the cylinder head gasket, EGR cooler, turbocharger cooling, charge air cooler and the like. The cooling system 12 may therefore include an auxiliary tank 35 (such as a shunt tank or a surge tank) for storing coolant whilst compensating for an increase in volume of the coolant due to thermal expansion and to de-aerate or degas the liquid coolant. The auxiliary tank 35 may be a standalone component, as illustrated in FIG. 1, or it may be integrated into the cooling device, for example the cooling device inlet tank (known as the header). The auxiliary tank 35 may have an opening 36 disposed in a top portion thereof and a cap 37 releasably connected to the top portion and operatively positioned to seal the opening 36. The cap 37 may be a pressure cap or it may be a simple cap with an associated pressure control device. The pressure control device may be built into the cap 37 or may be a standalone component in the auxiliary tank 35. The pressure cap or pressure control device may have an inlet valve and an outlet valve. The cap 37 and/or pressure control device may control the pressure in the auxiliary tank 35 during operation by opening the outlet valve to relieve pressure when a predetermined maximum pressure in the auxiliary tank 35 is reached. The cap 37 and/or pressure control device may also relieve a vacuum created in the auxiliary tank 35 due to thermal shrinking of the fluid during cooling by opening the inlet valve when a predetermined minimum pressure in the auxiliary tank 35 is reached. The cap 37 may be fluidly connected to an overflow tank 38 by means of a spill line 39, such when the outlet valve opens, excess coolant may flow to the overflow tank 38. The cooling system 12 may not include an overflow tank 38, for example if the auxiliary tank 35 is sufficiently large or where spillage of coolant is acceptable. The cap 37 may also enable the air, gas and vapours to vent to atmosphere.

At least one engine vent line 55 may be provided for venting air from the engine 11 to allow degassing of the engine 11 during operation and to prevent airlocks whilst the engine system 10 is filled with coolant. The auxiliary tank 35 may also be fluidly connected to the cooling flow path, for example via the cooling device outlet conduit 28, by means of a shunt line 40, also known as a fill line. Filling of the cooling system 12 with coolant may be achieved by removing the cap 37 from the auxiliary tank 35 and adding coolant through the opening 36. The coolant may pass through the shunt line 40 to the engine 11 and into the cooling device 15. The cooling device 15 may also be provided with a cooling device vent line 41, which is connected to the auxiliary tank 35, which may allow aerated coolant to flow from the cooling device 15 to the auxiliary tank 35 for deaerating the coolant. When the auxiliary tank 35 is integrated into the cooling device 15, a shunt line 40 may not be present and the cooling system 12 may be filled directly via the coolant pump inlet conduit 29/cooling device outlet conduit 28. This may lead to the previously stated problems that the engine 11 is unable to warm up, as the at least one engine vent line 55 may be positioned too high and coolant from the at least one engine vent line 55 may pass through the cooling device 15.

If there are space or other constraints, the auxiliary tank 35 may be omitted. The cooling device 15 may be of the type shown in FIG. 2, which may include an inlet tank 45, which provides an expansion volume designed to keep the pressure in the cooling system 12 within limits set by the cap 37 and/or associated pressure control device. The inlet tank 45 may be located in the highest part of the cooling device 15 above the coolant head 46. The cooling device 15 may include a cap 37 and/or pressure control device, similar to that described previously, located in the top portion of the cooling device 15 releasably connected to the top portion and operatively positioned to seal an opening 36 in the top of the cooling device 15. In this arrangement, coolant is added to the cooling system 12 directly via the cooling device 15. The cap 37 may be connected to a recovery tank 47, which may not be pressurised, by means of a recovery line 48. The cap 37 may also include a coolant return valve (not shown) which enables the return of coolant to the cooling device 15. The recovery tank 47 may be used to accommodate the increased volume of coolant produced in response to an increase in temperature and store the coolant for eventual return into the cooling system 15 as temperatures decrease. The coolant may return to the cooling device 15 via the recovery line 48 and cap 37 when required. During operation of the engine 11, or potentially during or after shutting down the engine 11, the temperature and the pressure of the coolant may decrease, causing coolant return valve to open in response to the decrease in pressure. The recovery tank 47 may be provided with a cap 37, which may not include a pressure control device, which may be connected to a spill line 39. In the event of an overfilled cooling system 12 reaching high temperatures, the spill line 39 may vent to atmosphere or to a separate open catch tank (not shown).

Figure 2:
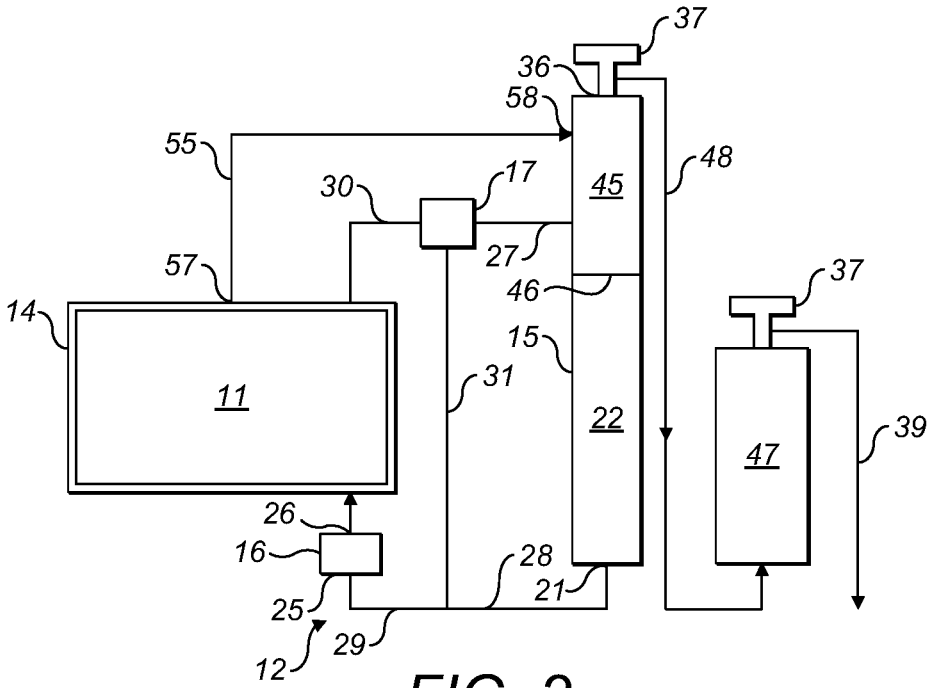
FIG. 2 is a diagrammatic representation of an engine system including an engine and an alternate cooling system to that of FIG. 1.
Figure 3:
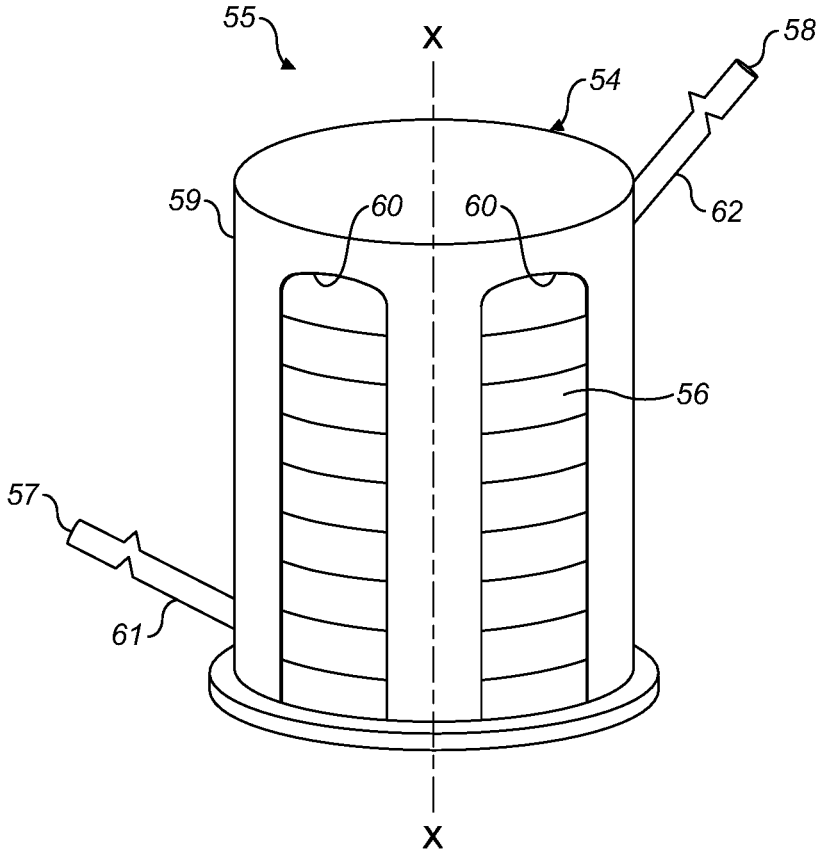
FIG. 3 is a pictorial representation of a vent line unit of the cooling system of FIG. 1 or 2.

In another alternative arrangement (not shown), similar to that of FIG. 2, the recovery tank 47 may not be included and the cap 37 may be connected directly to the spill line 39, which vents to atmosphere. The installation may incorporate an expansion gap in the cooling system 12, which is usually the highest point or the coolant head 46.

The auxiliary tank 35 or inlet tank 45 may be connected to the engine 11 by the at least one engine vent line 55, which bypasses the coolant flow circuit (i.e. the cooling flow path and bypass flow path). The at least one engine vent line 55 may convey aerated coolant from the engine 11 to the auxiliary tank 35 or inlet tank 45. The at least one engine vent line 55 may bypass the temperature control device 17 and the coolant flow circuit (i.e. the cooling and bypass flow paths). The at least one engine vent line 55 may have a vent line inlet 57 which is connected to the engine 11, for example to the engine cooling jacket 14 and/or other parts of the engine 11 such as an EGR cooler or a transmission cooler and a vent line outlet 58, which may be connected to the auxiliary tank 35 or inlet tank 45. The auxiliary tank 35 or inlet tank 45 may be located relative to the engine 11, such that they are at the highest point of the engine system 10.

The at least one engine vent line 55 may be configured to provide a vent flow rate (i.e. the rate of coolant flow in the at least one engine vent line 55) which is limited to a value that produces a heat loss in the cooling device 15 low enough to enable engine warmup in cold ambient conditions and under light load duty. The maximum heat loss and thus vent flow rate requirements for a particular engine system 10 may be determined by the control strategy of the emission control systems. The vent flow rate may therefore be limited by the hydraulic diameter and length of the at least one engine vent line 55 to create a pressure drop due to friction losses as the coolant flows along the at least one engine vent line 55, thereby reducing the rate of coolant flow along the at least one engine vent line 55. The hydraulic diameter of the at least one engine vent line 55 may be determined by its internal diameter and/or the internal diameter of an orifice within the at least one engine vent line 55. The hydraulic diameter of the at least one engine vent line 55 may be selected according to engine size, the hydraulic diameter of the at least one engine vent line 55 of larger engines generally requiring a greater hydraulic diameter than that used in smaller engines. However, the at least one engine vent line 55 may have a minimum hydraulic diameter, which may be limited by other requirements, such as resistance to blockage by debris or due to manufacturing requirements. In one example, the minimum hydraulic diameter may be in the range of 1-5 mm. The minimum hydraulic diameter may be in conflict with the maximum coolant flow rate and thus with the maximum allowable heat loss. The at least one engine vent line 55 may also have a maximum hydraulic diameter, which may be limited by requirements such as packaging (i.e. configuration of the engine system 10). In one example the maximum hydraulic diameter may be 30 mm. The at least one engine vent line 55 may have a low hydraulic diameter compared to the other flow paths in the cooling system 12, although not necessarily the lowest. The hydraulic diameter D for the at least one engine vent line 55 may be selected to be as small as possible taking into account the constraints mentioned above. In one non-limiting example, this may be 3 mm. For convenience, this may be based on a standard hose size (such as ⅛", 1/10").

Maximum and minimum engine vent flow rate targets (the vent flow rate being the flow rate of coolant within the at least one engine vent line 55) may be determined using testing, computer simulation or modelling for a particular engine system 10 (i.e. engine specific values). The maximum engine vent flow rate target may be the vent flow rate which produces a heat loss in the cooling device 15 low enough to enable engine 11 warm up in cold ambient conditions and operate under light load duty. The minimum engine vent flow rate target may be that required to enable degassing of the engine 11 during operation and to prevent airlocks whilst the engine system 10 is filled with coolant.

The length of the at least one engine vent line 55, for a selected hydraulic diameter, which meets the maximum and minimum flow rate targets may be determined by an interpolation process using the Darcy-Weisbach formula:

$$\Delta p = f(L/D) \times (V^2/2g)$$

where:

$\Delta p$=head loss (m)

f=Darcy friction factor

L=length (m)

D=hydraulic diameter (m)

V=flow velocity (m/s)

g=acceleration due to gravity ($m/s^2$)

The Darcy friction factor may be indicative of the frictional losses within the at least one engine vent line 55 and may be determined by the Reynolds number for the flow and the degree of roughness of the inner surface of the at least one engine vent line 55. The Darcy friction factor may be determined from a Moody Chart that relates the Darcy friction factor, Reynolds number and surface roughness for fully developed flow in a circular pipe. Alternatively, the Darcy friction factor may be determined by the Colebrook-White equation or one of its approximations.

The head loss $\Delta p$ (i.e. pressure drop) across the at least one engine vent line 55 for an engine system 10 is the difference between the inlet and outlet pressures at the vent line inlet 57 and vent line outlet 58. The required engine head loss $\Delta pd$ is that which allows the engine 11 to reach engine warm up in cold ambient conditions and under light load duty, and this may be predetermined using testing, computer simulation or modelling for a particular engine system 10 (i.e. engine specific values).

To calculate the length of the at least one engine vent line 55 which meets the required engine head loss $\Delta pd$, a number of combinations of nominal length L and nominal hydraulic diameter D (in which at least on combination may include the minimum hydraulic diameter) for the at least one engine vent line 55 may first be selected. The nominal length may be the same in each combination or may be different. The Darcy-Weisbach equation may be used to calculate the head loss $\Delta p$ for a range of flow velocities V for each combination of nominal length L and hydraulic diameter D. The flow velocities V may be converted to flow rates, based on the cross-sectional area for the at least one engine vent line 55.

Figure 4:
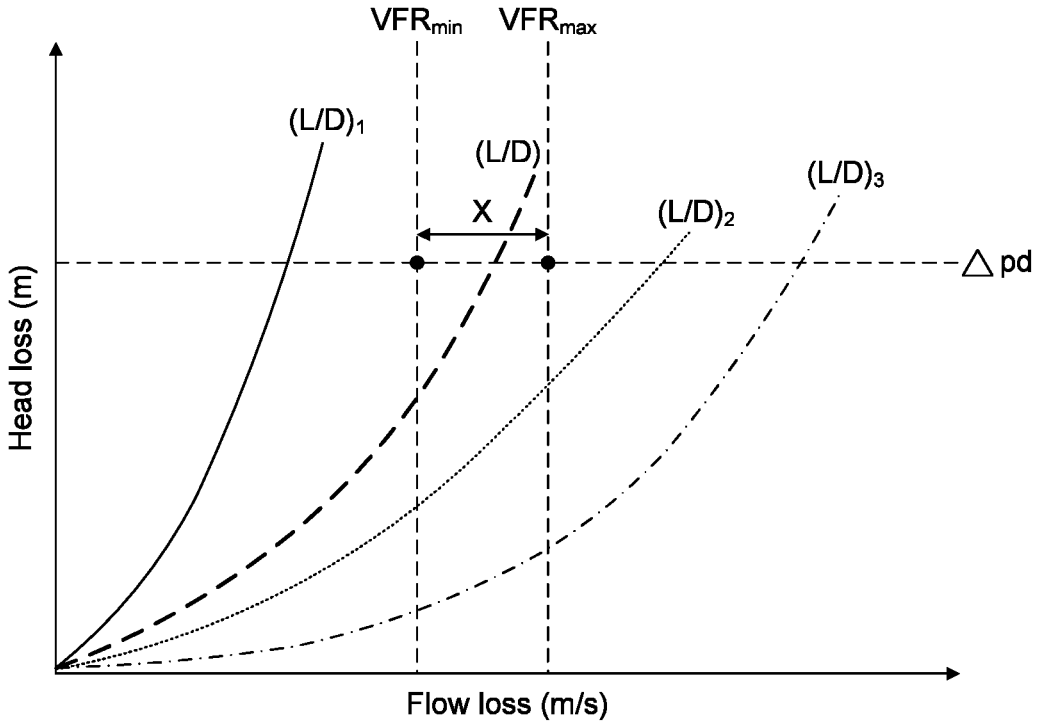
FIG. 4 is a graph showing pressure against flow rate, for determining the length of a vent line in the cooling system of FIGS. 1 to 3.

The head losses Δp for each flow rate may be plotted on a Head Loss v Flow Rate graph of FIG. 4, to provide flow rate curves $(L/D)_1$, $(L/D)_2$, $(L/D)_3$ . . . $(L/D)_n$. It should be noted that, although only 3 flow rate curves are illustrated in FIG. 4, any number of combinations of (L/D) may be calculated and plotted. The maximum and minimum vent flow rate targets (lines $VFR_{max}$ and $VFR_{min}$) and the required engine head loss Δpd (line Δpd) for the particular engine system 10 for which the length of the at least one engine vent line 55 is being calculated can also be seen on the graph. Values for an (L/D) combination may be interpolated from the flow rate curves $(L/D)_1$, $(L/D)_2$, $(L/D)_3$ . . . $(L/D)_n$ which intersect the engine head loss Δpd line between the ($VFR_{max}$ and $VFR_{min}$) (i.e. the region marked X on the graph). This is shown by the dotted flowrate curve (L/D) in FIG. 4. With the interpolated length L and hydraulic diameter D from the selected combination (which may include the minimum hydraulic diameter or a hydraulic diameter as close to the minimum hydraulic diameter as possible) and the determined engine head loss Δpd for the engine system 10, the Darcy-Weisbach formula may again be used to confirm that the calculated flow rate lies between maximum and minimum vent flow rate targets. If the calculated flow rate does not lie between maximum and minimum vent flow rate targets, the hydraulic diameter D, and possible the length L, may be adjusted and the calculation performed again until a combination is found for which the calculated flow rate lies between maximum and minimum vent flow rate targets. This combination may then be used for the at least one engine vent line 55.

Although the method described above includes using both maximum and minimum vent flow rate targets, it may use just a maximum vent flow rate target. In this method, a single L/D combination which would intersect the engine head loss Δpd line at or below the maximum vent flow rate target may be interpolated.

The at least one engine vent line 55 may comprise a helical section 54 in which a portion of the at least one engine vent line 55 is formed into a helix, which provides a helical path having a central axis X-X. When the at least one engine vent line 55 is installed in engine system 10, the central axis X-X may be vertical, horizontal or at an angle to the vertical or horizontal. The at least one engine vent line 55 may have an inlet pipe 61 which leads to the lowermost end of the helical section 54 and which may be connected to the engine 11. The inlet pipe 57 may connect the vent line inlet 57 to one end of the helical section 54. The at least one engine vent line 55 may have an outlet 58, which may be fluidly connected to the auxiliary tank 35 or the inlet tank 45. Depending on the location of the central axis X-X when the at least one engine vent line 55 is installed in engine system 10, the at least one engine vent line 55 may have a steady uphill gradient extending from the vent line inlet 57 to the vent line outlet 58.

The helical section 54 may be contained a housing 59, which may have one or more apertures 60 through which at least a part of the helical section 54 may be visible. The at least one engine vent line 55 and housing 59 may be made of any suitable material which is designed to handle the type of temperatures and pressures present in a cooling system 12 for an engine 10, such as drawn steel, ethylene propylene diene monomer (EDPM), rubber, chloroprene (CR) rubber, nitrile (NBR, HNBR) rubber or silicon rubber or a combination thereof. Where the at least one engine vent line 55 is formed from a single continuous hose, the material may be flexible to enable it to be coiled or otherwise formed to provide a plurality of adjacent coils 56. Alternatively at least the helical section 54 of the at least one engine vent line 55 may be made from an extruded tube (for example of plastic), which may be thermoformed to provide a coiled shape.

The at least one engine vent line 55, or at least the helical section 54, may be made from a transparent or semi-transparent material (such as polypropylene, reinforced PVC or reinforced silicone rubber), such that a viewer may be able to determine the presence of coolant in the helical section 54 of the at least one engine vent line 55. The helical section 54 may thus provide a visualisation of the coolant level when the engine 11 is switched off. Appropriate markings may be provided on the housing 59 adjacent the one or more apertures 60, indicative of the minimum and maximum coolant levels in the engine system 10 when the engine 11 is switched off.

Alternatively, the helical section 54 may comprise a moulded component defining a helical channel therein and separate hoses may be connected to the upper and lower ends of the helical section 54 to provide the vent line inlet 57 and vent line outlet 58.

INDUSTRIAL APPLICABILITY

A length of the at least one engine vent line 55 may be determined for a particular engine system 10, in which the hydraulic diameter may be at least the minimum hydraulic diameter or close thereto, which may ensure that the coolant is not able to pass through the at least one engine vent line 55, which may otherwise delay or prevent the engine 11 from reaching the minimum operating temperature. This may be achieved, by using the Darcy-Weisbach equation and a process of interpolation, to determine the length of the at least one engine vent line 55 in which the backpressure is such as to prevent or restrict coolant flow within the at least one engine vent line 55, whilst still meeting the predetermined engine head loss Δpd and at least a maximum vent flow rate target, or both a maximum and a minimum flow rate target. In other words, the backpressure within the at least one engine vent line 55 may be such as to allow the engine 11 to get up to operating temperature in cold ambient conditions and under light load duty. Increasing the restriction to flow in the at least one engine vent line 55 may restrict or prevent coolant flow along the at least on engine vent line 55, thereby forcing more coolant through the coolant flow circuit.

Where the length and hydraulic diameter of the at least one engine vent line 55 meet these requirements, this may allow the engine system 10 to be configured without the use of an auxiliary tank, which may lead to lower packaging requirements and costs for the engine system 10.

As the length of the at least one engine vent line 55 meeting this requirement may be considerably longer than may be used in prior art systems, the use of a helical section 54 may enable the additional length to be conveniently accommodated. It may also provide the additional benefit of providing a convenient visible means of determining the coolant level in the engine system 10 when the engine 11 is switched off. In prior art engines this may be done by opening the cap of the cooling device (radiator).

What is claimed is:

1. An engine system comprising:

an engine;

a cooling system comprising a cooling device, a coolant flow circuit fluidly connecting the engine and the cooling device and a pump for circulating coolant through the coolant flow circuit;

at least one engine vent line fluidly connected to the engine for venting air from the engine system and bypassing the coolant flow circuit, said at least one engine vent line having a hydraulic diameter and length selected to provide a predetermined engine head loss for the engine and a rate of flow of coolant in the at least one engine vent line at or below a maximum engine vent flow rate target during operation of the engine, said at least one engine vent line comprising a helical section in which a portion of the at least one engine vent line is formed into a helix.

2. The engine system as claimed in claim 1 in which the at least one engine vent line is formed from a continuous hose and the helical section is provided by a coiled section of the hose.

3. The engine system as claimed in claim 1 in which at least the helical section of the at least one engine vent line is extruded and thermoformed.

4. The engine system as claimed in claim 1 in which at least the helical section of the at least one engine vent line is a moulded component defining a helical channel therein.

5. The engine system as claimed in claim 1 in which the helical section is contained in a housing having one or more apertures in which at least a part of the helical section is visible.

6. The engine system as claimed in claim 1 in which the helical section is formed from a transparent or semi-transparent material.

7. The engine system as claimed in claim 1 in which the hydraulic diameter and length of the at least one engine vent line are selected to provide a predetermined engine head loss for the engine and a rate of flow of coolant in the at least one engine vent line above a minimum engine vent flow rate target during operation of the engine.

* * * * *